US009263823B2

(12) United States Patent
Oshita

(10) Patent No.: US 9,263,823 B2
(45) Date of Patent: Feb. 16, 2016

(54) LEVER CONNECTOR

(75) Inventor: Osamu Oshita, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/985,412

(22) PCT Filed: Feb. 16, 2012

(86) PCT No.: PCT/JP2012/053671
§ 371 (c)(1),
(2), (4) Date: Aug. 14, 2013

(87) PCT Pub. No.: WO2012/111753
PCT Pub. Date: Aug. 23, 2012

(65) Prior Publication Data

US 2013/0323953 A1 Dec. 5, 2013

(30) Foreign Application Priority Data

Feb. 17, 2011 (JP) ..... 2011-032358

(51) Int. Cl.
*H01R 13/62* (2006.01)
*H01R 13/52* (2006.01)
(Continued)

(52) U.S. Cl.
CPC ..... *H01R 13/5205* (2013.01); *H01R 13/62933* (2013.01); *H01R 13/741* (2013.01)

(58) Field of Classification Search
CPC .. H01R 13/62933; H01R 13/658; H01R 4/04; H01R 13/5833; H01R 13/639
USPC ..... 439/372, 373, 559
See application file for complete search history.

(56) References Cited

U.S. PATENT DOCUMENTS 5,104,333 A * 4/1992 Hatagishi et al. ..... 439/342
5,123,862 A 6/1992 Suzuki
5,487,680 A * 1/1996 Yamanashi ..... 439/552
(Continued)

FOREIGN PATENT DOCUMENTS

CN 201210554 Y 3/2009
JP 4-5078 U 1/1992
(Continued)

OTHER PUBLICATIONS

International Search Report and Written Opinion of the International Search Report for PCT/JP2012/053671 dated May 15, 2012.
(Continued)

*Primary Examiner* — Phuong Dinh
(74) *Attorney, Agent, or Firm* — Kenealy Vaidya LLP

(57) ABSTRACT

A lever connector includes a first connector housing, a second connector housing that includes a distal fitting portion intended for a distal end of the first connector housing to be fittedly connected thereto, and is adapted to be attached to a connector attaching plate in a state of inserting the second connector housing through a connector attaching hole of the connector attaching plate, a lever adapted to fit the first connector housing into the second connector housing by a pivoting operation, and a grommet for ensuring a waterproofing property of an inside of the first connector housing. The lever includes a lever body, a pivoting connection portion, and a lever locking piece. The grommet is fitted and mounted on the lever and includes a lever covering portion, and a tubular.

1 Claim, 8 Drawing Sheets

(51) Int. Cl.
*H01R 13/629* (2006.01)
*H01R 13/74* (2006.01)

(56) References Cited

U.S. PATENT DOCUMENTS

| | | | | | |
|---|---|---|---|---|---|
| 5,586,909 | A | * | 12/1996 | Saba | 439/559 |
| 5,993,226 | A | | 11/1999 | Yamaguchi | |
| 6,050,839 | A | * | 4/2000 | Seminara et al. | 439/364 |
| 6,835,094 | B2 | * | 12/2004 | Matsushita | 439/559 |
| 2009/0203251 | A1 | | 8/2009 | Takahashi et al. | |

FOREIGN PATENT DOCUMENTS

| | | | |
|---|---|---|---|
| JP | 6-144130 | A | 5/1994 |
| JP | 9-283225 | A | 10/1997 |
| JP | 10-233262 | A | 9/1998 |
| JP | 11-67350 | A | 3/1999 |
| JP | 2001-217033 | A | 8/2001 |
| JP | 2001-244021 | A | 9/2001 |
| JP | 2009-193670 | A | 8/2009 |

OTHER PUBLICATIONS

Japanese Office Action for the related Japanese Patent Application No. 2011-032358 dated Dec. 2, 2014.
Japanese Office Action for the related Japanese Patent Application No. 2011-032358 dated Feb. 10, 2015.
Chinese Office Action for the related Chinese Patent Application No. 201280009542.4 dated Feb. 28, 2015.
Pretrial Report of Japanese Office Action for the related Japanese Patent Application No. 2011-032358 dated Jun. 16, 2015.
German Office Action for the related Germany Patent Application No. 11 2012 000 881.2 dated Jul. 9, 2015.

* cited by examiner

LEVER CONNECTOR

TECHNICAL FIELD

The present invention relates to a lever connector, in which a first connector housing is fittedly connected to a second connector housing by a pivoting operation of a lever, and a waterproof grommet is mounted on the first connector housing.

BACKGROUND ART

FIGS. 6 to 8 show an example of a lever connector according to the related art.

A lever connector 100 shown in the figures is that disclosed in PTL1 as described below, and is used for connecting cables (electric wires) 160 inside and outside a connector attaching plate (panel) 150, such as a door panel for vehicles.

In the lever connector 100, a fitting connection between a first connector housing 110 and a second connector housing 120 is obtained by a pivoting operation of a lever 130 attached to the first connector housing 110.

As shown in FIG. 6, the lever 130 has a cover shape adapted to accommodate the first connector housing 110. As shown in FIG. 7, a grommet 140 for waterproofing the first connector housing 110 is mounted on the lever 130 in which the first connector housing 110 is accommodated.

As shown in FIG. 8, the lever connector 100, in which the fitting connection between the first connector housing 110 and the second connector housing 120 has been completed, is attached to the connector attaching plate 150 in a state in which the grommet 140 is mounted on the lever 130.

The grommet 140 has a panel fitting portion 141 adapted to be pressed into a connector attaching hole 151 of the connector attaching plate 150, when the lever connector 100 is attached to the connector attaching plate 150. The panel fitting portion 141 is tightly fitted on a peripheral edge of the connector attaching hole 151, thereby waterproofing the connector attaching hole 151 through which the lever connector 100 is inserted.

CITATION LIST

Patent Literature

PTL1: JP-A-2009-193670

SUMMARY OF INVENTION

Technical Problem

However, in the lever connector 100 disclosed in PTL1, an operation of pressing the panel fitting portion 141 into the connector attaching hole 151 takes time, thereby causing a problem in which mounting efficiency of the grommet 140 is poor.

In addition, fixation of the lever connector 100 to the connector attaching plate 150 is obtained via the panel fitting portion 141 of the grommet 140, and thus a tensile load or a bending load, which is exerted to the lever connector 100 from the cable 160 connected to the lever connector 100, is also applied to the panel fitting portion 141, thereby causing a problem in which the grommet 140 is easily damaged.

Accordingly, an object of the present invention is to solve the above problems, and to provide a lever connector, in which a grommet is not required to be pressed into a connector attaching hole of a connector attaching plate, a mounting efficiency of the grommet is good, and also, the grommet can be prevented from being damaged by a load which is exerted to a connector housing through a cable.

Solution to Problem

The object of the present invention is achieved by the following configuration.

(1) A lever connector, including:

a first connector housing;

a second connector housing that includes a distal fitting portion intended for a distal end of the first connector housing to be fittedly connected thereto, and is adapted to be attached to a connector attaching plate in a state of inserting the second connector housing through a connector attaching hole of the connector attaching plate;

a lever adapted to fit the first connector housing into the second connector housing by a pivoting operation; and a grommet for ensuring a waterproofing property of an inside of the first connector housing;

wherein the lever includes:

a lever body that is formed independently of the first connector housing and is adapted to press a rear end of the first connector housing, which is abutted on the second connector housing attached to the connector attaching plate, toward the second connector housing;

a pivoting connection portion that pivotally connects one end of the lever body to the connector attaching plate, so that the lever body performs a lever behavior for pressing the rear end of the first connector housing toward the second connector housing; and a lever locking piece that is provided on the other end side of the lever body and is adapted to fix the other end side of the lever body to the connector attaching plate when fitting between the first connector housing and the second connector housing has been completed by the lever behavior of the lever body;

wherein the grommet is fitted and mounted on the lever and includes:

a lever covering portion that is coupled to the lever body by a lip having a groove adapted to be fitted on an outer peripheral edge of the lever body; and a tubular that is integrally formed with the lever covering portion and is adapted to receive a cable connected to the first connector housing; and wherein when fitting between the connector housings has been completed by the lever behavior of the lever, the lip is tightly contacted with a peripheral edge of the connector attaching hole to ensuring the waterproofing property of the inside of the first connector housing.

According to the configuration of the above (1), the grommet ensuring the waterproofing property of preventing that infiltration of water or the like into the first connector housing is formed independently of the first connector housing, is fitted and mounted on the lever pivotally attached to the connector attaching plate, and thus is tightly contacted with the connector attaching plate by a pivoting operation of the lever, thereby exhibiting the waterproofing property.

Therefore, an operation of pressing the grommet into the connector attaching hole of the connector attaching plate is not required, and thus as compared to conventional cases in which a portion of the grommet is pressed into the connector attaching hole of the connector attaching plate, the grommet can be easily mounted, thereby enhancing assembly efficiency.

In addition, the grommet is attached to the connector attaching plate, independently of the first connector housing and the second connector housing. In other words, because the first connector housing and the second connector housing are attached to the connector attaching plate, not via the grommet, it is difficult for a load, which is exerted to the connector housings through a cable, to be applied to the grommet. As a result, the grommet can be prevented from being damaged by the load, which is exerted to the connector housings through the cable.

DESCRIPTION OF EMBODIMENTS

A preferred embodiment of a lever connector according to the present invention will be now described in detail with reference to the accompanying drawings.

Figure 1:
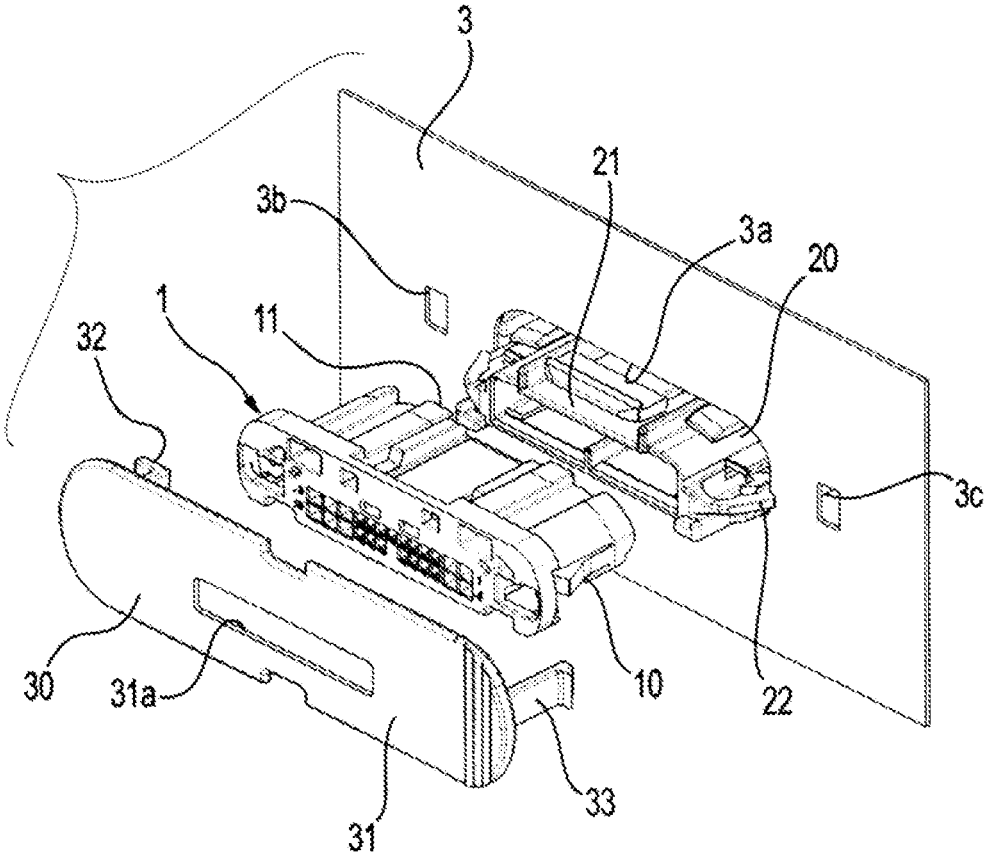
FIG. 1 is an exploded perspective view showing one embodiment of a lever connector according to the present invention.
Figure 2:
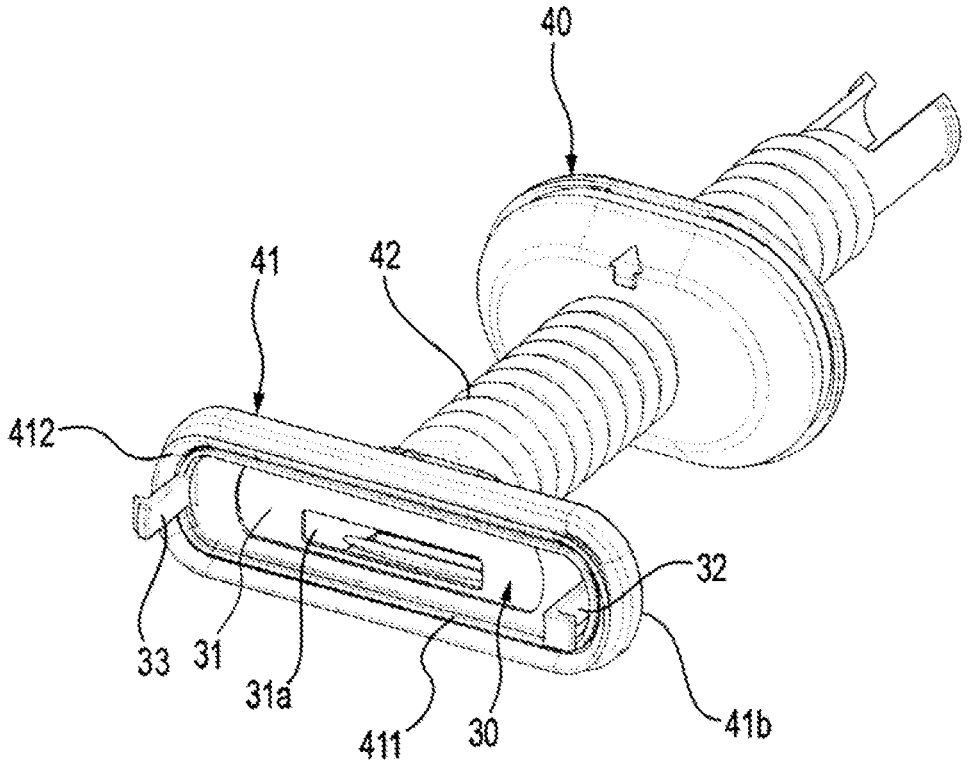
FIG. 2 is a perspective view showing a grommet fitted and mounted on a lever shown in FIG. 1.

A lever connector 1 according to the embodiment is used for connecting cables (electric wires), not shown, inside and outside a connector attaching plate 3 which is, for example, a panel for vehicles, and as shown in FIGS. 1 and 2, includes a first connector housing 10, a second connector housing 20, a lever 30, and a grommet 40.

The first connector housing 10 is a connector housing intended for a cable outside the connector attaching plate 3 to be connected thereto. The first connector housing 10 has a distal end 11 fitted into the second connector housing 20 as described below.

The second connector housing 20 is a standby connector adapted to wait on the connector attaching plate 3 to be fittedly connected to the first connector housing 10. The second connector housing 20 has a distal fitting portion 21 intended for the first connector housing 10 to be fittedly connected thereto. In addition, the second connector housing 20, as shown in FIG. 1, is engaged and fixed to the connector attaching plate 3 in a state of inserting the distal fitting portion 21 through a connector attaching hole 3*a* of the connector attaching plate 3.

In the present embodiment, the second connector housing 20 has panel fixing pieces 22 adapted to perform a fixation to the connector attaching plate 3, when the distal fitting portion 21 is inserted through the connector attaching hole 3*a* while the second connector housing 20 is not connected to the first connector housing 10. The panel fixing pieces 22 are provided on both side of the distal fitting portion 21.

The lever 30, in short, forces the first connector housing 10 to be fitted into the second connector housing 20 by a pivoting operation. The lever 30 according to the present embodiment is a component independent of the first connector housing 10, and, as shown in FIG. 3, includes a lever body 31, a pivoting connection portion 32 and a lever locking piece 33.

The lever body 31 is formed independently of the first connector housing 10. As shown in FIGS. 3 and 4, the lever body 31 is a plate-shaped member for pressing a rear end of the first connector housing 10, which is abutted on the second connector housing 20 attached to the connector attaching plate 3, toward the second connector housing 20. The lever body 31 has a generally elliptical shape, and as shown in FIG. 1, is provided on a central portion thereof with an opening 31*a* formed for allowing a cable to be inserted therethrough.

Figure 3:
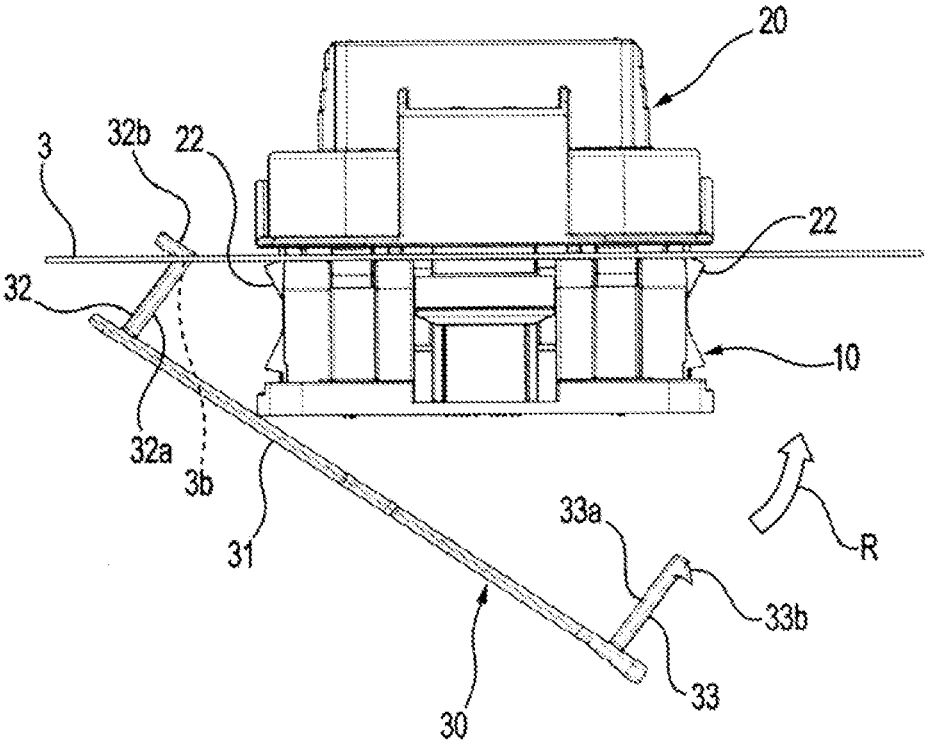
FIG. 3 is a plan view showing a state in which one end of the lever shown in FIG. 1 is pivotally coupled to a connector attaching plate.
Figure 4:
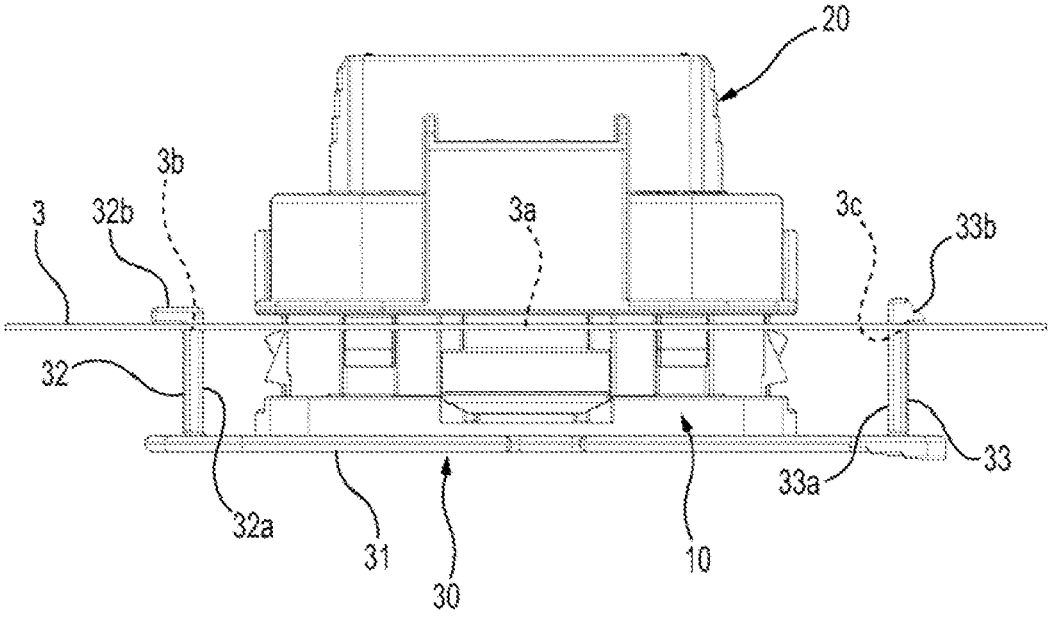
FIG. 4 is a plan view showing a state in which a fitting connection between a first connector housing and a second connector housing has been completed by a lever behavior of the lever shown in FIG. 3.

As shown in FIGS. 3 and 4, the pivoting connection portion 32 is constituted of an arm portion 32*a* substantially vertically extended from the lever body 31 on one end side of the lever body 31, and a locking claw portion 32*b* provided in a hook shape on a distal end of the arm portion 32*a*. As shown in FIG. 3, the locking claw portion 32*b* is engaged in a first lever supporting hole 3*b* (see FIG. 1) provided in the connector attaching plate 3, so that the one end of the lever 30 can be pivotally connected to the connector attaching plate 3.

The pivoting connection portion 32, as described above, pivotally connects the one end of the lever body 31 to the connector attaching plate 3, so that the lever body 31 can perform a lever behavior (a lever manner operation) for pressing the rear end of the first connector housing 10 toward the second connector housing 20 as shown in FIGS. 3 and 4.

An arrow R as shown in FIG. 3 indicates a pivoting direction when the lever 30 performs the lever behavior.

As shown in FIGS. 3 and 4, the lever locking piece 33 is constituted of an arm portion 33*a* substantially vertically extended from the lever body 31 on the other end side of the lever body 31, and a locking protrusion 33*b* protruded from a distal end of the arm portion 33*a* toward the outside perpendicular to the arm portion 33*a*.

As shown in FIG. 4, the locking protrusion 33*b* is engaged in a second lever supporting hole 3*c* (see FIG. 1) provided in the connector attaching plate 3, so that the other end side of the lever 30 can be fixed to the connector attaching plate 3.

The lever locking pieces 33, as described above, is provided on the other end side of the lever body 31, and when fitting between the first connector housing 10 and the second connector housing 20 has been completed as shown in FIG. 4, fixes the other end side of the lever body 31 to the connector attaching plate 3.

The grommet 40 is fitted and mounted on the lever 30, thereby preventing infiltration of water or the like into the first connector housing 10.

Figure 5:
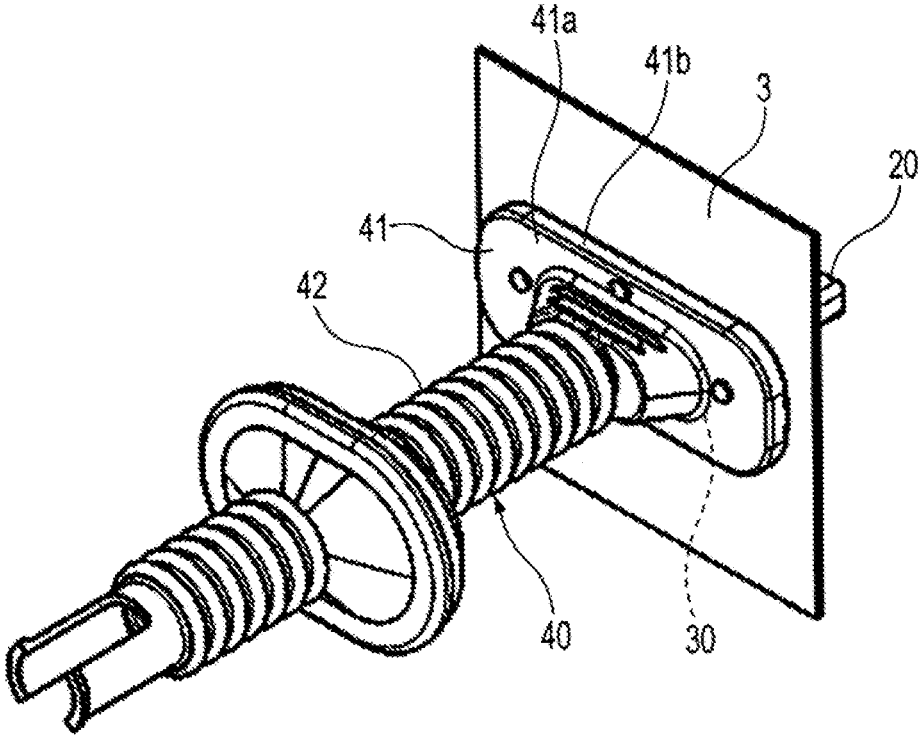
FIG. 5 is a perspective view showing a state in which the fitting connection between the first connector housing and the second connector housing shown in FIG. 1 has been completed and then the first connector housing is waterproofed by a grommet.
Figure 6:
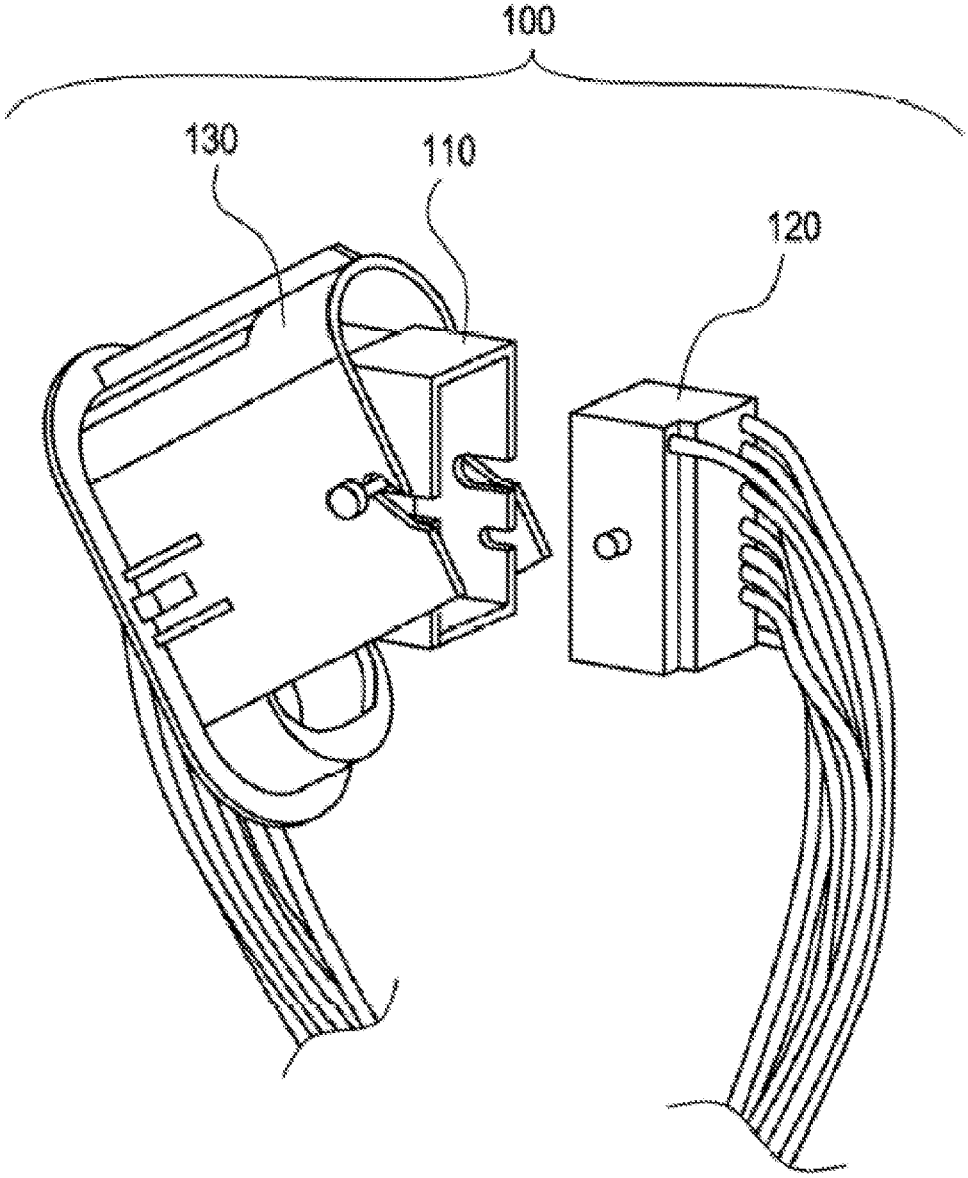
Fig. 6 RELATED ART
FIG. 6 is an exploded perspective view showing a first connector housing and a second connector housing constituting a lever connector according to the related art.
Figure 7:
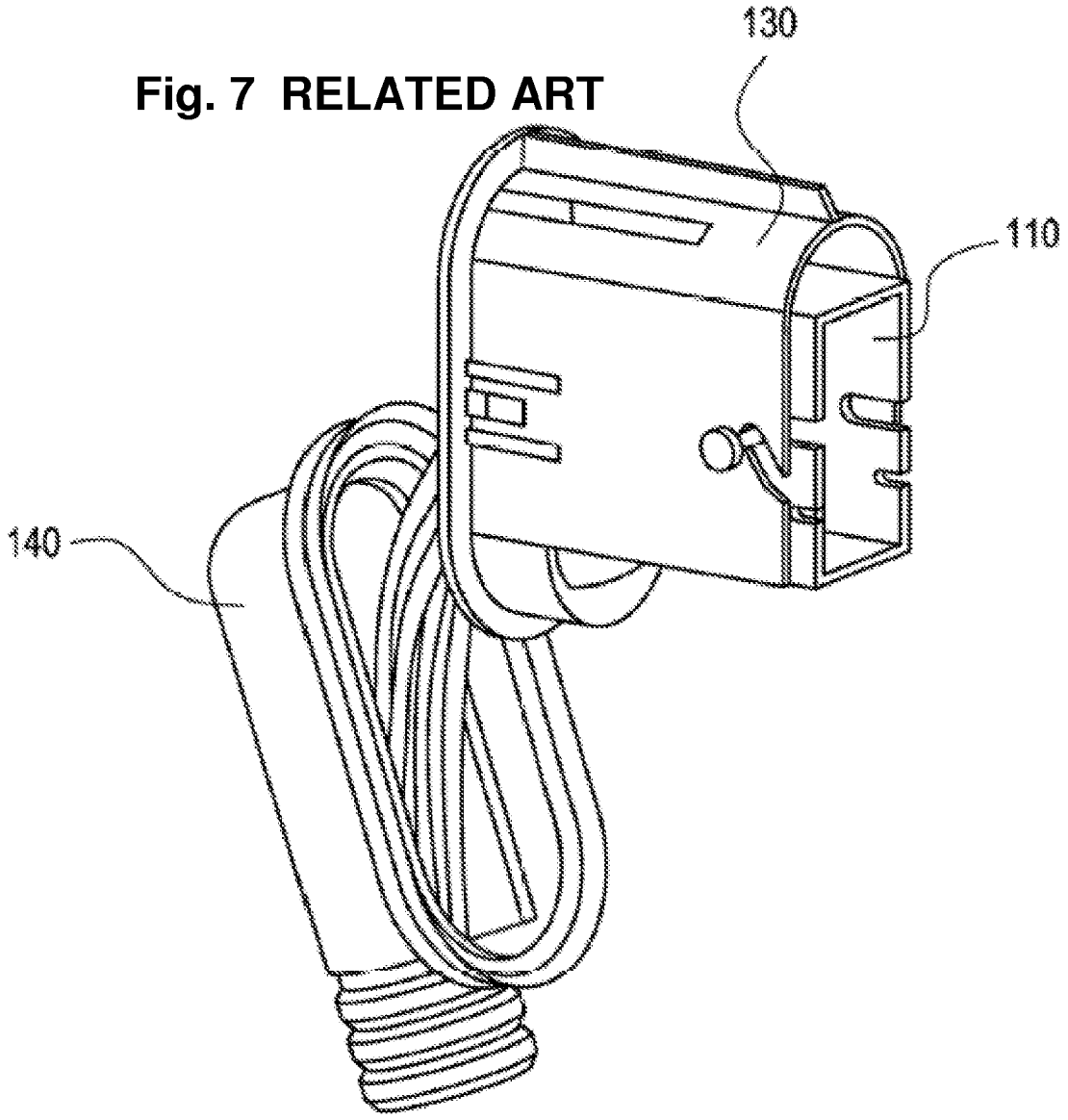
Fig. 7 RELATED ART
FIG. 7 is a perspective view showing a grommet equipped to the first connector housing shown in FIG. 6.

The grommet 40 is made of an elastic material, such as a synthetic rubber, having a waterproofing property, and as shown in FIGS. 2 and 5, includes a lever covering portion 41 adapted to be fitted and mounted on the lever 30, and a tubular portion 42 integrally formed with the lever covering portion 41. The tubular portion 42 receives the cable connected to the first connector housing 10.

As shown in FIG. 5, the lever covering portion 41 has a lip 41*b* formed on the entire circumference of an outer peripheral edge of a generally elliptical-shaped covering portion body 41*a* adapted to cover an outer surface of the lever body 31.

As shown in FIG. 2, the lip 41*b* has a groove 411 adapted to be fitted on an outer peripheral edge of the lever body 31, and a ridge 412 extending toward the connector attaching plate 3.

The lever covering portion 41 is fixed to the lever 30 by fitting the groove 411 of the lip 41*b* on the outer peripheral edge of the lever body 31.

The grommet 40 mounted on the lever 30, as described above, is adapted such that the ridge 412 of the lip 41*b* is tightly contacted with a peripheral edge of the connector attaching hole 3*a* when fitting between the connector housings has been completed by the lever behavior of the lever 30, thereby ensuring the waterproofing property of preventing infiltration of water or the like into the first connector housing 10.

According to the lever connector 1 of the present embodiment as described above, the grommet 40 ensuring the waterproofing property of the inside of the first connector housing 10 is formed independently of the first connector housing 10, is fitted and mounted on the lever 30 pivotally attached to the connector attaching plate 3, and thus is tightly contacted with the connector attaching plate 3 by a pivoting operation of the lever 30, thereby exhibiting the waterproofing property.

Figure 8:
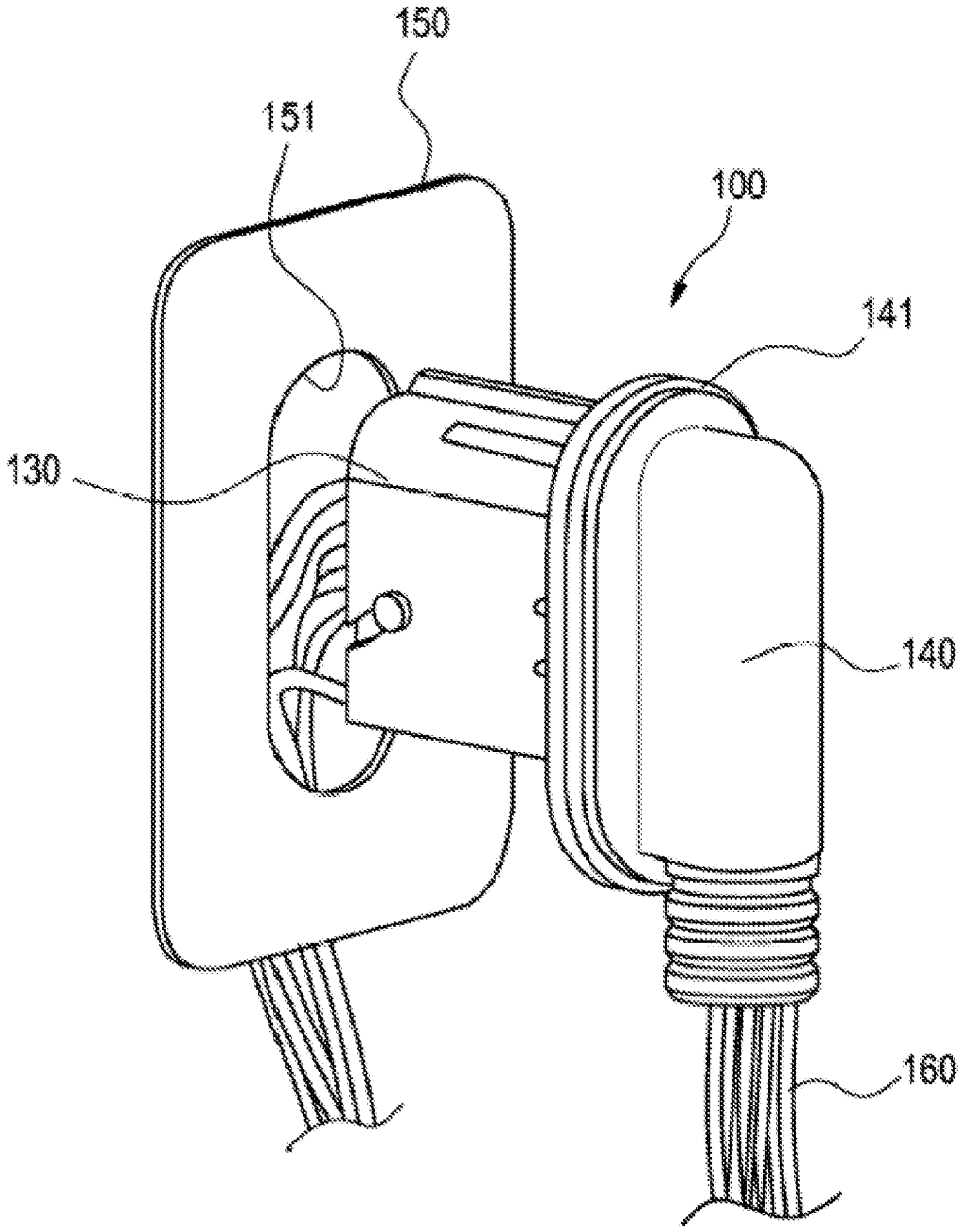
Fig. 8 RELATED ART
FIG. 8 is a perspective view showing a state before the lever connector shown in FIG. 6 is fixed to a connector attaching plate.

Therefore, an operation of pressing the grommet 40 into the connector attaching hole 3*a* of the connector attaching plate 3 is not required, and thus as compared to conventional cases in which a portion of the grommet 140 is pressed into the connector attaching hole 151 of the connector attaching plate 150 (see FIG. 8), the grommet 40 can be easily mounted, thereby enhancing assembly efficiency.

In addition, according to the lever connector 1 of the present embodiment as described above, the grommet 40 is attached to the connector attaching plate 3, independently of the first connector housing 10 and the second connector housing 20. In other words, because the first connector housing 10 and the second connector housing 20 are attached to the connector attaching plate 3, not via the grommet 40, it is difficult for a load, which is exerted to the connector housings through the cable, to be applied to the grommet 40. As a result, the grommet 40 can be prevented from being damaged by the load, which is exerted to the connector housings through the cable.

Meanwhile, the present invention is not limited to the foregoing embodiment, but appropriate changes, modifications or the like thereof can be made. In addition, material, shape, dimension, number, installation position and the like of each of the components of the foregoing embodiment are not limited but arbitrary as long as the present invention can be achieved.

For example, an installation position of the second connector housing is not limited to a panel of vehicles or the like, but may be a wall surface or the like of a case for various electronic and electrical equipment.

In addition, this application claims the benefit of Japanese Patent Application No. 2011-032358 filed on Feb. 17, 2011, the entire contents of which are incorporated herein by reference.

Industrial Applicability

According to the lever connector of the present invention, the grommet ensuring the waterproofing property of the inside of the first connector housing is fitted and mounted on the lever pivotally attached to the connector attaching plate, and thus is tightly contacted with the connector attaching plate by a pivoting operation of the lever, thereby exhibiting the waterproofing property.

Therefore, an operation of pressing the grommet into the connector attaching hole of the connector attaching plate is not required, and thus as compared to conventional cases in which a portion of the grommet is pressed into the connector attaching hole of the connector attaching plate, the grommet can be easily mounted, thereby enhancing assembly efficiency.

In addition, because the first connector housing and the second connector housing are attached to the connector attaching plate, not via the grommet, it is difficult for a load, which is exerted to the connector housings through a cable, to be applied to the grommet. As a result, the grommet can be prevented from being damaged by the load, which is exerted to the connector housings through the cable.

REFERENCE NUMERALS LIST

1 Lever connector
3 Connector attaching plate
3*a* Connector attaching hole
3*b* First lever supporting hole
3*c* Second lever supporting hole
10 First connector housing
11 Distal end
12 Second connector housing
21 Distal fitting end
22 Panel fixing pieces
30 Lever
31 Lever body
32 Pivoting connection portion
33 Lever locking piece
40 Grommet
41 Lever covering portion
41*a* Covering portion body
41*b* Lip
42 Tubular portion
411 Groove
412 Ridge

The invention claimed is:

1. A lever connector, comprising:

a first connector housing;

a second connector housing that includes a distal fitting portion intended for a distal end of the first connector housing to be fittedly connected thereto, and is adapted to be attached to a connector attaching plate in a state of inserting the second connector housing through a connector attaching hole of the connector attaching plate;

a lever adapted to fit the first connector housing into the second connector housing by a pivoting operation; and a grommet for ensuring a waterproofing property of an inside of the first connector housing;

wherein the lever includes:

a lever body that is formed independently of the first connector housing and is adapted to press a rear end of the first connector housing, which is abutted on the second connector housing attached to the connector attaching plate, toward the second connector housing;

a pivoting connection portion that pivotally connects one end of the lever body to the connector attaching plate, so that the lever body performs a lever behavior for pressing the rear end of the first connector housing toward the second connector housing; and a lever locking piece that is provided on the other end side of the lever body and is adapted to fix the other end side of the lever body to the connector attaching plate when fitting between the first connector housing and the second connector housing has been completed by the lever behavior of the lever body;

wherein the grommet is fitted and mounted on the lever and includes:

a lever covering portion that is coupled to the lever body by a lip having a groove adapted to be fitted on an outer peripheral edge of the lever body; and a tubular that is integrally formed with the lever covering portion and is adapted to receive a cable connected to the first connector housing; and wherein when fitting between the connector housings has been completed by the lever behavior of the lever, the lip is tightly contacted with a peripheral edge of the connector attaching hole to ensuring the waterproofing property of the inside of the first connector housing.

* * * * *